US005572829A

United States Patent [19]

Stoltenberg

[11] Patent Number: 5,572,829

[45] **Date of Patent: *Nov. 12, 1996**

[54] POWER OPERATED GARAGE DOOR

[76] Inventor: Donald A. Stoltenberg, 419 N. Ashland Ave., Park Ridge, Ill. 60068

[ * ] Notice: The term of this patent shall not extend beyond the expiration date of Pat. No. 5,341,597.

[21] Appl. No.: 498,244

[22] Filed: Jun. 29, 1995

[51] Int. Cl.[6] ..... E05D 15/18

[52] U.S. Cl. ..... 49/200; 49/197; 49/199; 160/201; 160/191

[58] Field of Search ..... 49/197, 199, 200, 49/352; 160/201, 188, 191

[56] References Cited

U.S. PATENT DOCUMENTS

| | | | |
|---|---|---|---|
| 3,568,365 | 3/1971 | Pemberton | 49/197 |
| 3,616,575 | 11/1971 | Harris | 49/200 |
| 3,695,332 | 10/1972 | Bahnsen | 49/199 |
| 3,962,828 | 6/1976 | McAllister | 49/468 |
| 4,472,910 | 9/1984 | Iha | 49/200 |
| 4,765,093 | 8/1988 | Edwards, Jr. | 49/199 |
| 4,819,376 | 4/1989 | Taddei | 49/200 |
| 5,222,327 | 6/1993 | Fellows et al. | 49/199 |
| 5,239,777 | 8/1993 | Husselton | 49/200 |
| 5,341,597 | 8/1994 | Stoltenberg | 49/199 |
| 5,359,811 | 11/1994 | Klippert | 49/352 |
| 5,365,993 | 11/1994 | Jellá | 160/201 |
| 5,412,297 | 5/1995 | Clark et al. | 49/27 |

FOREIGN PATENT DOCUMENTS

| | | | |
|---|---|---|---|
| 94/25713 | 11/1994 | WIPO | 49/200 |

*Primary Examiner*—Brian K. Green
*Assistant Examiner*—Curtis A. Cohen
*Attorney, Agent, or Firm*—Neil M. Rose

[57] ABSTRACT

A power operated garage door of the type having a single section movable from a vertical closed position to a horizontal open position at the ceiling of the garage by cables which pull the door open and closed and are secured to the door by extensions of the journal bearings for pivotally supporting the lower edge of the door.

22 Claims, 4 Drawing Sheets

FIG. 1
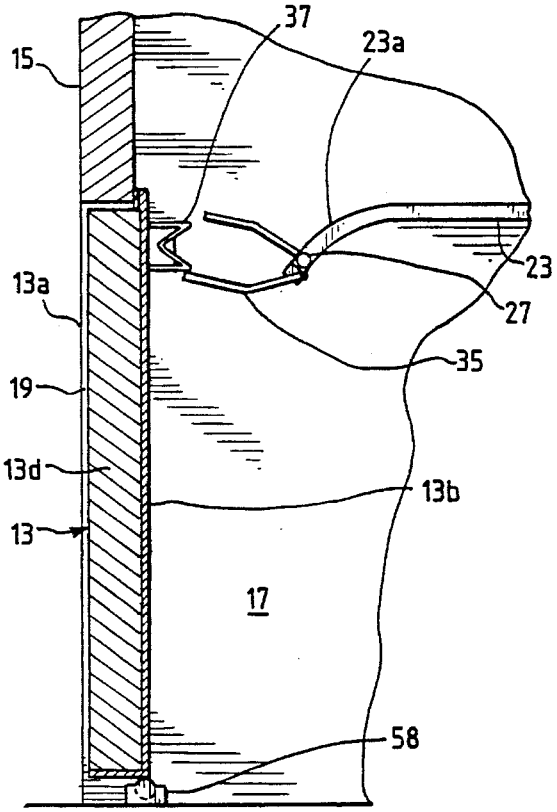
FIG. 2
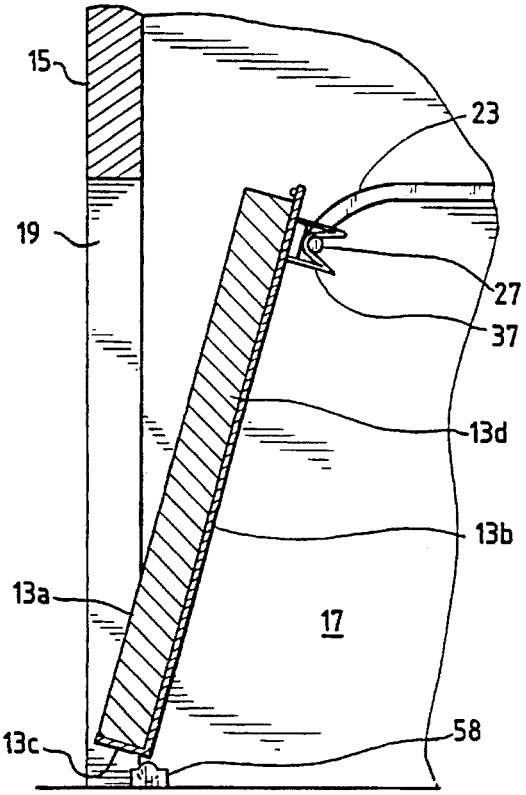
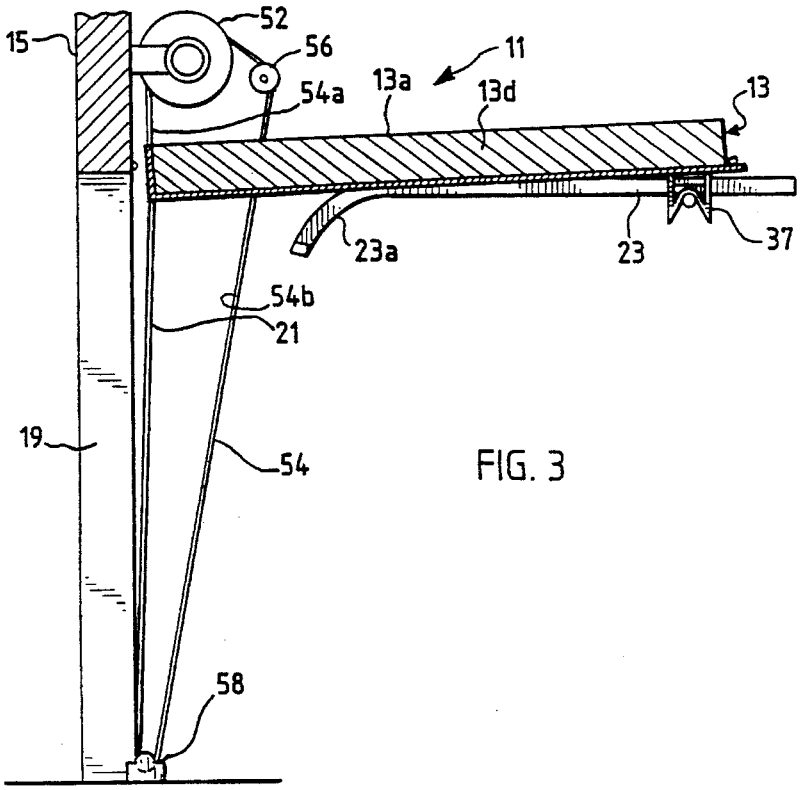
FIG. 3

FIG. 4
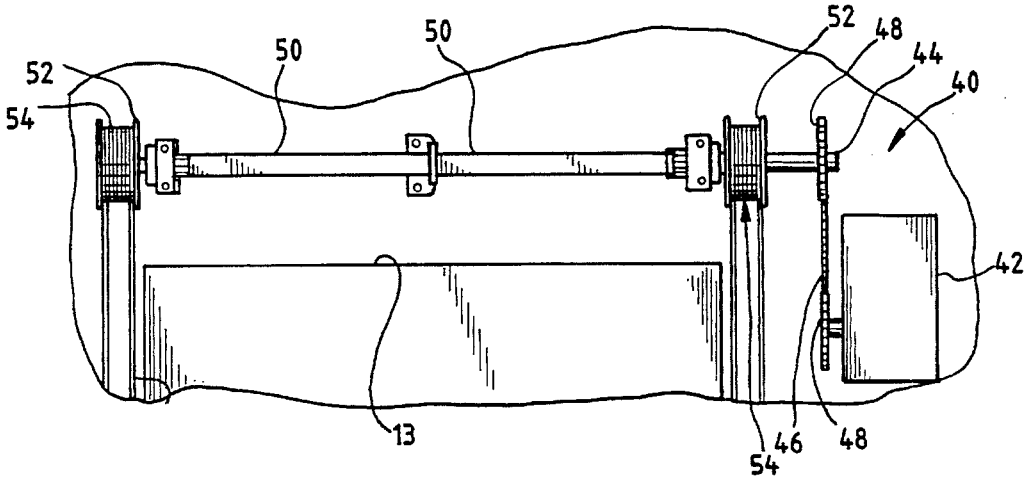
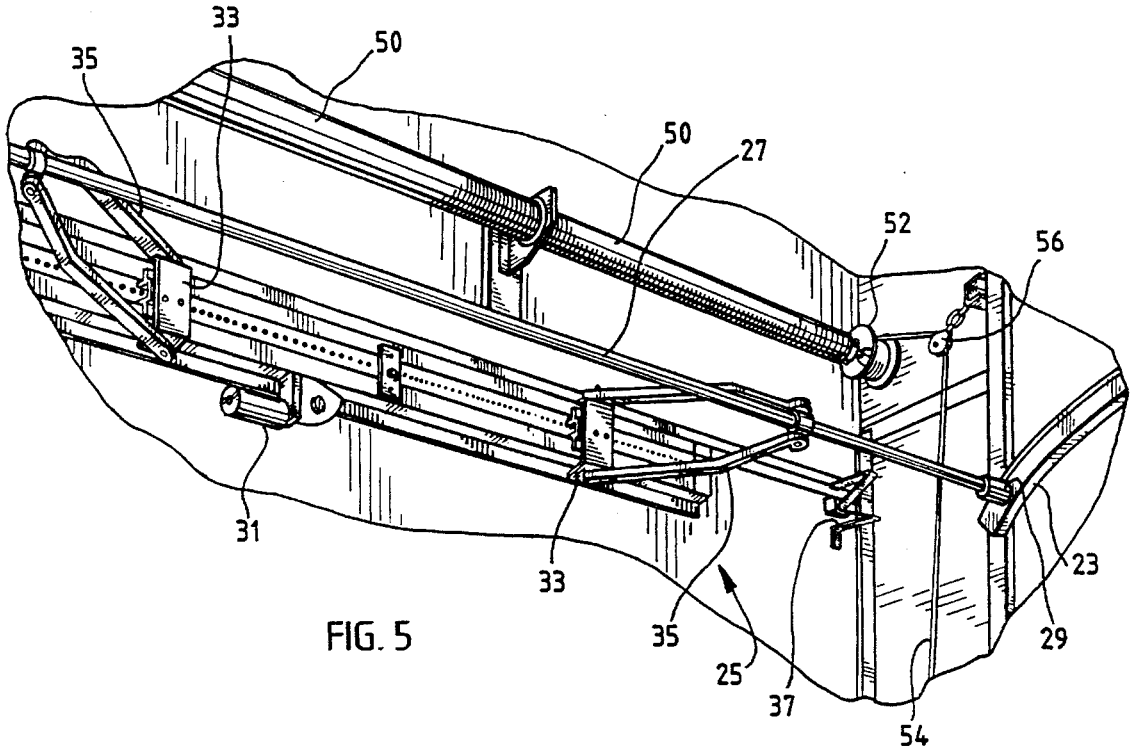
FIG. 5

POWER OPERATED GARAGE DOOR

BACKGROUND OF THE INVENTION

The present invention relates to power operated garage doors, and more specifically, to a power operated garage door of the type which may be installed in the wall of a house so that it is flush with the side wall of the house with an exposed outer surface of the door being of siding or masonry to blend in with the walls of the house providing a door which is essentially concealed from view.

Disclosed in my U.S. Pat. No. 5,341,597 issued on Aug. 30, 1994 on Power Operated Garage Door is a garage door adapted to be mounted with its exterior surface flush with the outside wall of a house so that the door may be made compatible with the side walls of the house and concealed from view. This type of door requires a mounting and an opening mechanism which are quite different from that found in the conventional domestic garage door in that, because of door's flush mounting, it must be shifted inwardly to clear the walls defining the door opening before it may be moved upwardly. The problem of mounting and raising the door is further complicated by the fact the door itself is much greater in weight due to the fact that door must be adapted to support a layer of masonry corresponding to the outer surface of the walls of the house. The door may in some instance weigh three or four times as much as a conventional garage door.

As disclosed in my above cited patent, the garage door is supported by two sets of tracks positioned on both sides of the garage door opening. One of the sets of tracks is disposed substantially vertical and receives guides mounted at the lower edge of the door and causes the lower edge of the door to move vertically as the door moves between the open and closed positions. The other set of tracks extends inwardly along the ceiling of the garage and receives guides mounted at the upper edge of the garage door so that, as the door opens, the door moves from a vertical door closed position to horizontal door open position in which the door extends inwardly from the door opening across the ceiling of the garage.

As compared to the common multipaneled doors, the door of the present invention and as disclosed in the above cited patent is a one piece door. Although there are one piece doors in widespread use in residential garages, such one piece doors are typically light in weight and are raised and lowered by mechanisms that would not be readily adaptable to handling the weight associated with doors constructed to blend with the exterior configuration of a house as contemplated by the present invention. In order to cope with the loads associated with this type of door, it is contemplated that door would be raised and lowered by flexible connectors such as cables or link chains which would be arranged to pull the door up to open and pull it down to close it. The advantages of this type of drive arrangement are discussed in my above cited patent. In general, however, the use of the flexible connectors to drive the door to the closed position rather than rely on gravity to close the door allows the use of safety mechanisms that respond to the load on the drive motor to sense obstructions to the movement of the door.

One of the problems associated with driving a one piece garage door of high mass by means of cables or other flexible connectors relates to the connection between the connector and the door. Because of the fact that the door moves between a vertical and a horizontal position and is displaced inwardly from flush with the house wall to a position adjacent the ceiling of the garage, it is almost required that the point of connection be located at the point where the lower edge of the door is guided in the vertical tracks. If the connection is made directly to the door, problems may result from the changing of the direction of force application through the flexible connector if the point of connection is not located on the horizontal axis about which the door pivots. As disclosed in my above cited issued patent, this connection may be made at the shaft which typically supports the guide rollers received in the guide tracks. The very large loads carried by the flexible connectors when lifting a masonry surfaced door present serious design problems in providing a strong enough roller support shaft. The roller support shaft is likely to deform under such loads and cause the mechanism to malfunction. Rather than increasing the size and strength of the support shaft, it would be desirable to use the standard light weight shaft for the door guides and apply the lifting force through the flexible cables directly to the door. There is, however, limited space between the edge of the door and the guide track. The connection must be made in this space if it is to be interior of the house wall and if the cable is not to interfere with the door as it moves between the vertical and horizontal positions.

In the prior art door as exemplified by my above cited patent, the cable connection to the door was made through the axle which pivotally mounted the lower guide rollers received in the vertical tracks provided to guide the lower edge of the door as it moved between the open and closed positions. The axles and the rollers were offset inwardly of the inner face of the door. While this arrangement is typical of the positioning of garage door guide rollers for the conventional multi-panel garage door, when this approach is applied to the much heavier and thicker masonry faced doors of the present invention, it results in the lifting force being applied to the door at a point offset horizontally from the vertical plane in which the center of gravity of the door is located. Because of this offset of the lifting force with respect to the center of gravity, a turning moment is created on the door which in turn increases the frictional forces in the guide tracks as the door moves upwardly. In the interests of reducing the forces necessary to raise and lower the heavy doors associated with the flush doors with which this invention is concerned, it is important to minimize any frictional forces generated in connection with guiding the door as it moves between its open and closed positions.

There is another problem relating to the location of the lower bearing about which the door pivots as it moves between the open and closed positions. While it is desirable to locate the horizontal axis of this bearing beneath the door or as close to the bottom edge as possible, it is also necessary to provide sufficient space in the vertical direction below this bearing for the pull down cable to extend down around a floor mounted pulley and then extend upwardly to the drive roller. Therefore, the cable connection to the door should be positioned toward the bottom of the door but should not interfere with the sealing of the door against the floor when it is in the closed position. This positioning of the bearing and the cable connection is further complicated by the fact that if the bearing is located upwardly from the bottom of the door, the pivoting of the door will cause the bottom of the door to extend into the door opening preventing the use of a sealing flange along the edge of the door to seal against the wall defining the door opening. From the foregoing, it is clear that the positioning and location of the lower door support bearing and the cable connection to the door is complicated by the path of movement of the door and the sealing requirements and the need to make the cable connection in the very limited space between the edge of the door and the adjacent wall defining the door opening. The only teaching in the prior art as to the considerations involved in the location of the bearing and the form of the cable connection is found in my prior U.S. Pat. No. 5,341,597.

SUMMARY OF THE INVENTION

The invention is directed to a power operated garage door of the type in which the door itself is mounted within the garage opening so that the outer surface of the door is flush with the outer wall surface of a house allowing the door surface to be made of the same texture and appearance as the wall of the house, thereby concealing the presence of the door. Power means are provided to move the door inwardly out of the opening and then upwardly to a raised position disposed horizontally along the ceiling of the garage. The power means includes flexible connectors which extend from a powered drive means to a connection at the lower edge of the door so that the reversible power supply may pull the door upwardly to the open position or downwardly to the closed position.

The connection between the flexible connectors is made beneath the lower edge of the door and includes the mounting means for the guides which engage vertical tracks for guiding the vertical movement of the lower edge of the door. In a preferred embodiment, the vertical guides are extruded metal members which are engaged by molded plastic guides having integrally formed support axles disposed horizontally and received in journal bearings secured to the lower edge of the door. In order to permit the flexible connectors to be secured directly to the door and not through the guide support shafts, the journal bearings extend beyond the vertical edges of the door on both sides of the door, and each such bearing extension receives a thimble or bushing which connects the flexible connector to the journal bearing and, accordingly, to the door. The flexible connector, preferably a cable or roller chain, extends upwardly from the thimble to a reversible, powered pulley and extends downwardly from the thimble around a small pulley mounted on the floor of the garage and then upwardly to a connection with the reversible, powered pulley. The connection to the pulley is such that one of the cables is rolling up on the pulley when the other is feeding off of the pulley so that the power means may pull the door in either the direction to open it or to close it. With the cable connection being made to the bearing extensions closely adjacent to the vertical edges of the door, the large loads carried by the cables in raising the door are not carried by the door guide support shafts.

In order to permit the door to have a weather sealing flange extending around the door to engage the inner surface of the walls defining the door opening, the lower bearing to which the cables are attached is positioned at the inner surface of the door. Thus as the door pivots from the vertical to the horizontal, this sealing flange has no interfering engagement with the sides of the door opening. The lower bearings are inset slightly above the bottom edge of the door so that considering the space occupied by the lower edge door seal, there is a minimum space below the bearings for the cable to extend around the floor mounted pulley and upwardly to the powered pulley.

In order to reduce the size of the floor mounted pulley positioned beneath the door to receive the pull down flexible connector, the flexible connectors may be constructed with a heavy duty section to raise the door and a light duty section to apply the downward, closing force to the door. By using a smaller diameter cable for the pull down section of cable, a smaller diameter pulley may be used in the space below the lower edge of the door. However, to avoid creating slack in the cable sections as they wind on and off of the pulley on the jack shaft, it is necessary to have only one diameter cable winding on and off of the pulley on the jack-shaft. In order to achieve this objective of maintaining the tension in the cables, the pull down section of the cable is provided with a larger diameter section at the end which winds onto the pulley.

Among the safety requirements for certain types of power operated garage doors is that they be provided with a sensing edge along the lower edge of the door so that the closing of the door may be interrupted if the sensing edge encounters an object. The sensing edge is typically an elongated flexible structure which is crushable to actuate a switch on encountering an object anywhere along its length. When a switch of this type is used with a very heavy door, there is a tendency for the door to crush the sensing edge causing the door to overclose. In order to prevent such overclosing and deformation of the sensing edge, an adjustable stop is associated with the floor mounted pulleys of the present invention. The two adjustable stops on the floor pulleys allow the lowered or closed position of the door to be set precisely so that the door will not crush the sensing edge and so that the door will be properly aligned horizontally in its closed position.

Accordingly it is an object of the present invention to provide an improved garage door of the type which is flush mounted in the wall of a house and is pivoted inwardly before moving upwardly from a closed vertical position to an open horizontal position.

It is a further object of the present invention to provide an improved garage door of the type having flexible connectors driving the door between a closed vertical position and a raised horizontal position with the connection between the door and the flexible connectors being located at the mounting of the guides for the lower edge of the door.

It is another object of the present invention to provide an improved cable connection between a continuous drive cable and the lower edge of a garage door wherein the journal bearing for the guide means for the lower edge of the door serves as a connection point for a thimble secured to an intermediate position in the cable.

It is another object of the present invention to provide an improved power operated garage door having a one piece door which is pulled open and closed by a continuous cable having portions of different diameter wherein the cable portion to pull the door closed is of a lesser diameter than the cable portion to pull the door open.

Additional objects and advantages of the invention will become apparent as the following detailed description of the preferred embodiment is read in conjunction with the accompanying drawings which illustrate such preferred embodiment.

BRIEF DESCRIPTION OF THE DRAWINGS

FIG. 1 is a vertical section showing schematically the power operated garage door of the present invention in the vertical, closed position;

FIG. 2 is a vertical sectional view similar to FIG. 1 but showing the door in its inclined position prior to moving upwardly to the open position;

FIG. 3 is a vertical sectional view similar to FIGS. 1 and 2 but showing the door in the fully raised or open position;

FIG. 4 is a fragmentary elevational view of the upper portion of the garage door of the invention from the inside of the garage showing the drive means for the flexible connectors that drive the door upwardly and downwardly;

FIG. 5 is a fragmentary perspective view of the upper inside portion of the door showing the mechanism for tilting the door;

DESCRIPTION OF A PREFERRED EMBODIMENT

Figure 6:
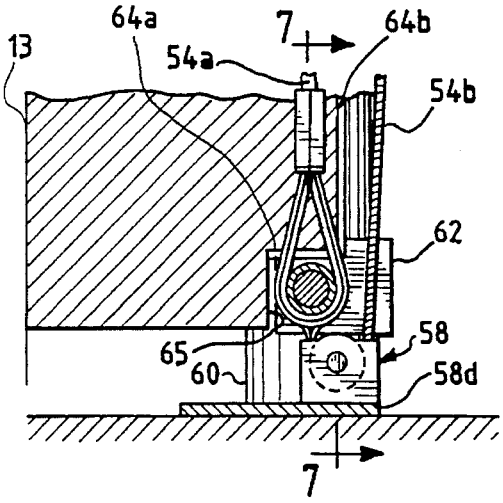
FIG. 6 is an enlarged fragmentary vertical sectional view taken transverse to the plane of the door showing the connection between the flexible cable and the door.

In the drawings, there is shown a power operated garage door embodying my invention and which is generally designated by the reference numeral 11. The views of FIGS. 1, 2 and 3 are somewhat schematic and are designed to illustrate the motion of garage door 13 in moving from a closed position as shown in FIG. 1 to an open or raised position as shown in FIG. 3. FIG. 2 shows the door 13 in its inwardly inclined position to which it moves from the closed position prior to moving upwardly to the raised position of FIG. 3. Shown in section is a side wall 15 of a house having a garage 17 with an opening 19 which may be of suitable width to accommodate one or two automobiles.

The door 13 has an outer surface 13a which is disposed flush or substantially coplanar with the surface of the side wall 15 of the house. The outer surface 13*a* of the door is colored and textured to correspond to the color and texture of the side wall 15 making it possible to conceal the garage door from view and make it appear to be part of the fixed wall of the house. It is contemplated that in a masonry house, the stone or brick facing would be applied to form the outer surface 13*a* of the door 13. The door 13 includes a planar member 13*b* on the inside surface with a ledge 13*c* extending along its lower edge to support a body portion 13*d* which may be constructed on the building site to correspond to siding or masonry side walls 15 of the house.

In order to provide a weather seal around the side and top edges of the door 13, there is provided a flange 13*f* which extends outwardly from the side and top edges of the door 13. The flanges 13*f* overlap and engage the inner surface of the walls defining the opening 19. As will become evident from the description below, the position of the pivot of the door 13 in moving between the vertical position of FIG. 1 to the horizontal position of FIG. 3 is such that the sealing flange 13f moves inwardly from the wall 15 and not into the opening 19.

In order to guide the movement of the door 13 in moving between the positions shown in FIGS. 1 and 3, there are provided two pairs of tracks. A first pair of vertical tracks 21 extend along the inside of the vertical edges of the opening 19. A second pair of tracks 23 extend inwardly and generally horizontally from the top of the garage opening 19. The tracks 23 have their outer ends 23*a* curved downwardly as shown in FIGS. 1–3 to provide a smooth transition as the turning motion of the door begins as it moves upwardly.

There are two mechanisms which operate sequentially to drive the door 13 as it is first tilted and then raised. These mechanisms are described in detail in my issued patent U.S. Pat. No. 5,341,597 and will be described only generally herein. A scissors mechanism 25 shown in FIG. 5 is mounted on the door 13 and serves to move the door between the vertical and inclined positions shown in FIGS. 1 and 2. This mechanism includes a shaft 27 which carries at its outer ends roller guides 29 received in the horizontal tracks 23 to guide the upper edge of the door along a generally horizontal plane. A motor 31 is connected by roller chains to carriages 33 to drive the carriages toward or away from each other. This movement of the carriages 33 causes the shaft 27, which is connected to the carriages by arms 35, to move toward and away from the door 13. Shaft 27 is shown in its position spaced from the door 13 in FIGS. 1 and 5 while it is shown in its position closely adjacent the door 13 in FIGS. 2 and 3. Thus, as is illustrated in comparing FIGS. 1 and 2, the movement of the shaft 27 from its spaced position to its adjacent position causes the door 13 to move from its vertical to its inclined position. Once the door has moved to its inclined position, it is free to move upwardly without the top of the door 13 interfering with the top of the door opening 19.

In order to avoid over-stressing the mechanism 25, the door 13 is provided with support brackets 37 which receive the shaft 27 in the inclined position as shown in FIG. 2. Thus, as the weight of the door 13 is increasingly carried by the shaft 27 in moving from the inclined position, the brackets 37 transfer the door load to the shaft 27 rather than the mechanism 25.

For the purpose of lifting the door 13 after it has moved to the inclined position, there is provided a second mechanism 40 which includes a reversible motor 42 drivingly connected to a jack shaft 44 by means of a roller chain 46 and sprockets 48 as best shown in FIG. 4. This type of jack shaft 44 is often referred to in the garage door industry as a torsion bar. Mounted on the jack .shaft 44 are torsion springs 50 which perform the conventional function of counterbalancing part of the weight of the door to reduce the power required to raise the door 13. In the lowered position of the door 13 as shown in FIG. 1, the springs 50 are wound to the maximum extent providing a lifting force to counter-balance the weight of the door and reduce the power required of the motor 42 to lift the door. In the elevated position of the door 13 as shown in FIG. 3, the springs 50 are partially unwound reducing the counter-balancing force provided.

Also secured to the jack shaft 44 are cable pulleys 52 to which are drivingly secured cables 54. It is contemplated that sprockets and roller chains may be substituted for the pulleys 52 and cables 54. A first portion 54a of each cable extends downwardly from a pulley 52 to connect to the lower edge of the door 13 and a second portion 54*b* is connected to the lower edge of the door 13 and the end of the portion 54*a* which is also connected to the door edge. The portion 54*b* of each cable 54 then extends downwardly around a second pulley 58 mounted on the garage floor below the lower edge of the door 13. The pulleys 52 are arranged so that as the door 13 is opened, the portion 54*a* of each cable 54 winds onto one of the pulleys while its connected portion 54*b* unwinds causing the door 13 to move from the FIG. 2 position to the FIG. 3 position. In the reverse motion of the door, the portions 54*b* wind onto the pulleys 52 drawing the door downwardly as the portions 54*a* unwind from the pulleys 52.

The portion of the pulley onto which the cable 54 winds and unwinds is cylindrical so that the amount of cable wound onto the drum is always constant and there is no tendency for the cable to slacken or tighten as the door is moved between its open and closed positions. The pulleys 52 are conventional uniform diameter cable pulleys having grooves to receive the cable loops in a single layer with the free ends of the cable portions 54*a* and 54*b* being secured at the opposite flanges of the pulleys 52. There is sufficient length of cable so that the cable has one layer of turns filling the space between the end flanges with a portion extending down and around the floor pulley 58. As is evident from FIG. 4, the portion of the cable that extends down and around the floor pulley 58 feeds off the outermost portion of the drum of the pulley 52. When the door is in the raised position as shown in FIG. 3, the downwardly extending portion of the cable 54 feeds off the inner-most portion of the drum of pulley. Thus, as the pulleys raise and lower the door 52, there is a slight variation in the direction in which the cable 54 pulls at its attachment to the door 13 because the difference in the position along the drum of the pulley from which the cable extends downwardly. However, there is sufficient clearance between the edge of the door 13 and the track to permit the door to move upwardly and pivot without interfering with or engaging the cable 54.

Figure 7:
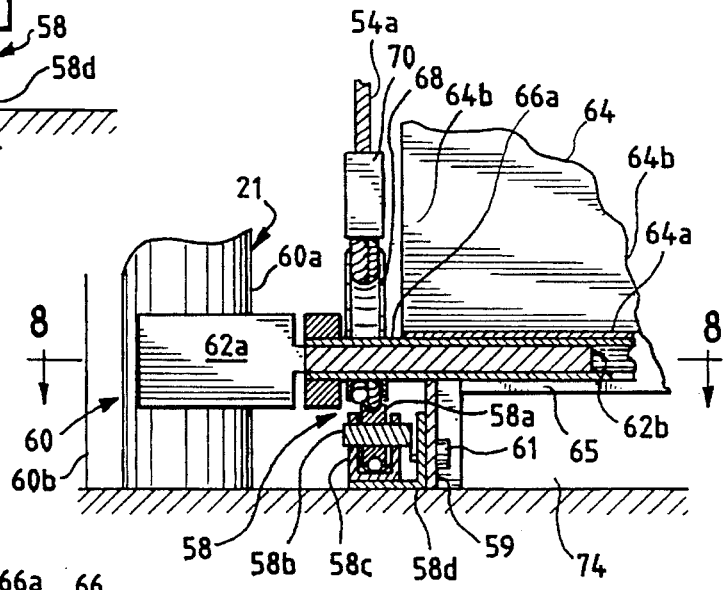
FIG. 7 is a vertical fragmentary sectional view taken substantially along line 7—7 of FIG. 6.
Figure 10:
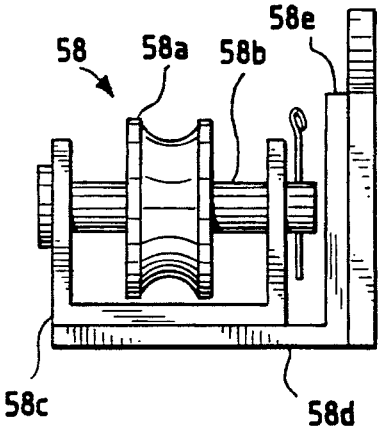
FIG. 10 is an enlarged elevational view of the floor mounted pulley for the flexible drive cable.
Figure 11:
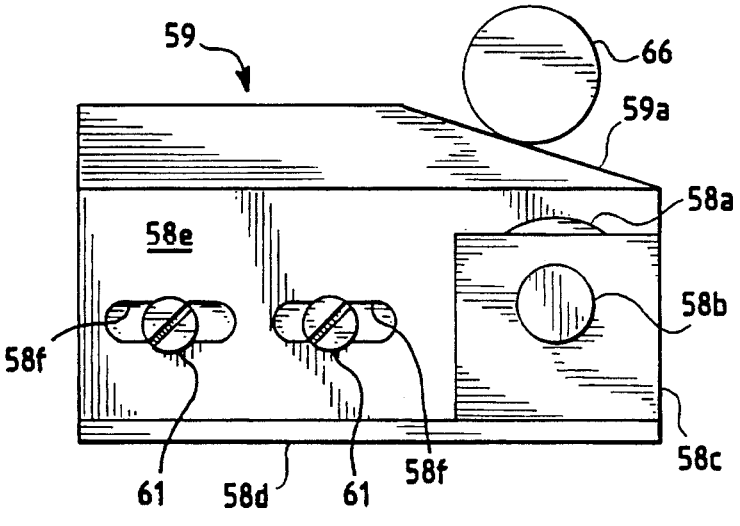
FIG. 11 is a right side elevational view of the pulley of FIG. 10.

As shown in FIG. 7, the pulley 58 includes a grooved roller 58*a* supported by an axle 58*b* and a U-shaped bracket 58*c*. An angle iron 58*d* forms a base member for the pulley as best shown in FIGS. 10 and 11. The base member 58*d* includes a horizontal plate portion secured to the floor of the garage and a vertically extending plate portion 58*e* to which is attached an adjustable door stop 59. The stop 59 is adjustably secured to the plate 58*e* by screws 61 threadedly received in the stop 59 and extending through elongated slots 58*f* in the plate 58*e*. As will be explained in detail below each stop 59 may be adjustably positioned in a direction perpendicular to the door 13 to control the location at which the door 13 stops in its descending movement.

Figure 8:
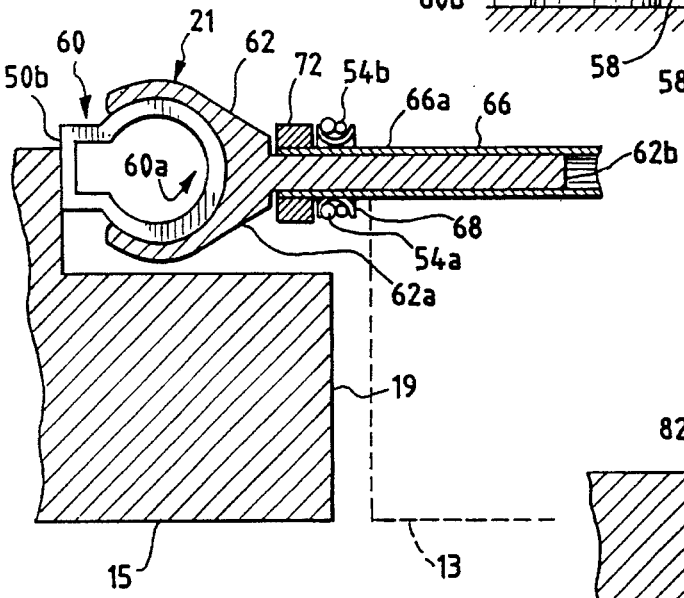
FIG. 8 is a horizontal sectional view taken substantially along line 8—8 of FIG. 7.

In FIGS. 6–8 the details of the connection between the cables 54 and the door 13 are shown. The horizontal tracks 23 are conventional channel shaped tracks in which flat disc rollers are received to guide the upper edge of the garage door 13. This is the type of guide track typically used in connection with multi panel garage doors and may be employed for both the horizontal and the vertical tracks. Alternatively, the vertical tracks 21 may take the form of extruded metal tubes 60 having cylindrical guiding portions 60*a* and mounting ribs 60*b* by means of which the tubes are secured to the house wall 15 adjacent the opening 19 as shown in FIG. 8. Adapted for sliding engagement with the tubes are the guides 62 which are formed of molded nylon or other suitable plastic material. Each guide 62 includes a sleeve portion 62*a* which partially encloses and slidably engages the cylindrical guiding portions 60*a* of the tubes 60. Each guide 62 also includes a bearing shaft 62*b* which serves to mount the guide 62 for rotational movement with respect to its mounting on the door 13.

Each guide 62 is mounted on the door 13 by means of a bearing plate 64 which is secured to the inner bottom corners of the door 13. The bearing plate 64 includes a flange 64*a* extending at a right angle to a body portion 64*b* which is flat against the inner surface of the door 13. The flange 64*a* extends along the lower edge of the door 13 in a notched out area 65 as shown in FIG. 6 and serves as the support for a cylindrical bearing 66 which is welded to the flange 64*a*. The bearing 66 is of a size to journal the bearing shaft 62*b* of the guide 62 for rotation about a horizontal axis. As shown in FIG. 7, the bearing 66 includes a bearing extension 66*a* which is the portion of the bearing 66 protruding beyond the edge of the door 13. The bearing extension 66*a* is the means by which the cables 54 are attached to the lower edge of the door 13.

In order to minimize wear and to allow the force exerted by the cable 54 to act through the horizontal axis of the guide shaft 62*b*, there is provided a bushing, ring or thimble 68 which is received on the bearing extension 66*a* as shown in FIGS. 6–8 and around which the ends of the cable portions 54*a* and 54*b* extend. The ends of the two cable portions are then secured together by a crimp connector 70 of the type commonly employed to secure stranded cable ends as in this case. The portion 54*a* extends around the thimble 68 and back up to be joined to itself by the connector 70. The cable portion 54*b* which is subjected to lesser loads than the portion 54*a* is unwound and half of the strands of the cable extended around opposite sides of the thimble 68. The end of the cable portion 54*b* which extends upwardly from the thimble 68 where the strands passing on either side of the thimble have rejoined is secured to the portions of the cable portion 54*a* by the connector 70. Thus the connector 70 encloses and secures together three sections of the cable 54, the two sections of cable portion 54*a* adjacent the loop extending around the thimble 68 and the end of the cable portion 54*b*. This arrangement provides a simple and effective means of securing both of the cable portions 54*a* and 54*b* to the bearing extension 66*a* using only a single crimp connector 70. The thimble 68 is retained on the bearing extension 66*a* by means of a collar 72 which is secured to the bearing extension 66*a* by a set screw or other suitable means.

Although the cable portions 54*a* and 54*b* may be made of stranded cable having the same diameter, it is preferred that the pull down cable portion 54*b* be made of a lesser diameter cable than the pull up cable portion 54*a*. In a constructed embodiment of the invention, a ⅛ inch diameter cable was employed for the pull down portion 54*b* while ¼ diameter inch cable was used for the pull up cable portion 54*a*. It is noted that the force on the cable portion 54*b* may be less than one hundred pounds while the force on the pull up cable portion 54*a* may exceed 500 pounds. The use of the smaller diameter cable on the pull down portion 54*b* allows the use of a small diameter pulley 58. In the example described above, the root diameter of the pulley wheel 58*a* was one half inch thereby reducing the space required and allowing the lower guide 62 to be positioned closer to the floor of the garage.

To understand the need to minimize the vertical space occupied by the pulley 58, it is necessary to review the design considerations involved in the location of the bearing for the lower guide 62 and the connection of the cable 54 to the door 13. By locating the cable connection at the guide 62, there are no interference problems that might otherwise develop when the door pivots about the guide 62 when moving between the open and closed positions in addition, the door pivot must be located toward the lower edge of the door 13 if it is to be pivoted without having the lower edge of the door flange 13*f* engage or interfere with the edges of the door. It is also important that the lower guide 62 and the pulley 58 be positioned so that they provide no interference with the sealing of the bottom edge of the door 13. It has been found that by recessing the lower guide bearing in a recess 65 in the inner surface of the lower edge of the door and minimizing the height of the pulley 58, an optimum arrangement is achieved.

Figure 12:
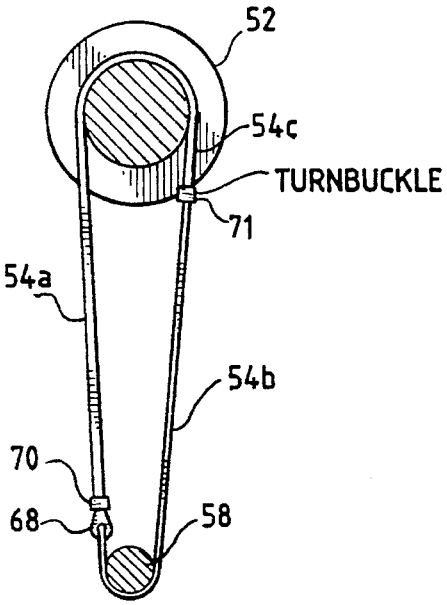
FIG. 12 is a schematic showing of one of the flexible drive cables for raising and lowering the power operated garage door of the present invention with the cable in the closed door position.
Figure 13:
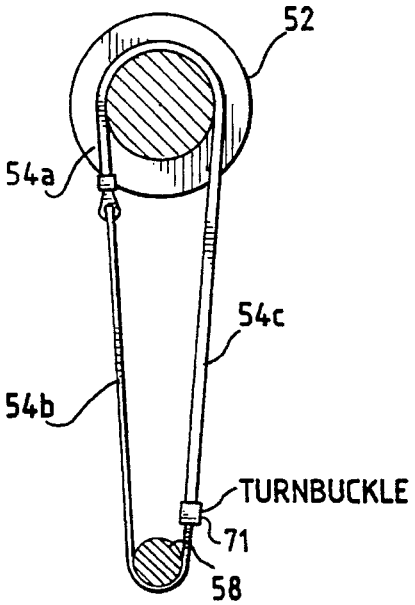
FIG. 13 is a schematic showing of one of the flexible drive cables similar to FIG. 12 but with the cables shown in the door open position.

In order to maintain a constant length of cable as its moves on and off of the pulley 52, it is necessary that the cable portions which wind onto and off of the pulley 52 be of equal diameter. To meet this requirement, it is necessary to add a heavier diameter portion to the cable portion 54*b* so that the portion which is wound on the pulley in the down position of the door is of the same diameter as the cable portion 54*a*. Thus as shown in FIGS. 12 and 13, a cable portion 54*c* is added to the end of cable portion 54*b* which would normally wind onto the pulley 52. In the example discussed above, the cable portion 54*b* is connected to the pulley by cable portion 54*c* which is ¼ inch in diameter as is portion 54*a*. A standard cable connector 71 connects one end of portion 54*c* to the remaining smaller diameter portions of 54*b*. With the above described arrangement, the same diameter cable winds onto the drum and winds off the drum of the pulley 52 at all times so the length of cable extending between the pulleys 52 and 58 remains unchanged and there is no tightening or slackening of the cable portions as the door 13 is opened or closed. Although not shown in detail in the drawings, the cable connector 71 preferably includes a turnbuckle to permit adjustment of the overall length of the cable 54 to compensate for stretching of the cable over a period of use.

It is also important to note that the pulleys 52 and 58 must be carefully positioned with respect to the vertical tracks 21 if the door is to move between the closed and open position without tightening or slackening the cable 54. To achieve the desired relationship, the cable portion 54*a* must be positioned in the same plane as the vertical tracks 21. As best shown in FIG. 3, the pulley 52 and the pulley 58 are mounted so that the cable portion 54*a* and the cable portion 54*b* feeding around the pulley 58 as the door opens extends vertically. Thus, as the guides 62 are carried upwardly by the cable 54, the cable maintains a straight line between the pulleys 52 and 58 avoiding any tightening or slackening of the cable 54.

Mounted along the bottom edge of the door 13 is a sensing edge or safety bar 74 as shown in FIG. 7. The sensing edge 74 extends across the entire length of the bottom edge of the door and serves to interrupt the closing of the door whenever the bar 74 encounters an obstruction. FIG. 7 illustrates that the sensing edge extends to a point adjacent the edge of the door 13 and the pulley 58 and door stop 59. It is contemplated that the edge of the door 13 not shown would be similarly arranged with the sensing edge extending to a point adjacent the door edge and adjacent to the door stop 59. A switch means associated with the bar 74 is actuated to perform the power interruption function providing a backup safety in the event the safety circuit associated with the motor 42 fails to operate when the door encounters an obstacle. In its usual form, the sensing edge is formed with an elongated box-like housing of resilient material which is deformed on impact with an object of actuating the switch contained within. However, the substantial weight of the door 13 has a tendency to crush the sensing edge 74 sometimes creating a permanent deformation of the resilient housing or allowing the door 13 to out of level in its closed position. Accordingly, it is desirable to provide a stop at both ends of the sensing edge in order to prevent crushing of the sensing edge and to assure that the door stops with the lower edge disposed horizontally.

The door stop 59 described above in connection with the pulley 58, is formed with an angled surface 59*a* which engages the bearing 66. By adjustably positioning the stops 59 using the screws 61, the amount of downward travel of each corner of the door 13 may be controlled to avoid crushing the sensing edge 74 and to assure its horizontal positioning.

Figure 9:
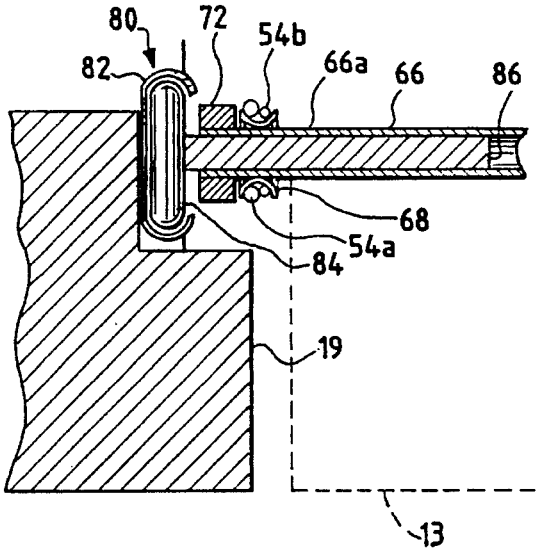
FIG. 9 is a horizontal sectional view similar to FIG. 8 but showing an alternative embodiment of the vertical guide track.

While the embodiment of the power operated garage door described above discloses a cable for transmitting the mechanical force between the jack shaft 44 and the door 13, it should be understood that it is contemplated that a roller chain may be used as an alternative. The roller chain would be connected to the bearing extension 66*a* using a bushing, thimble or other connecting means. It is also contemplated that the vertical tracks 21 may be replaced by vertical tracks 80 one of which is shown in FIG. 9. The tracks 80 include vertically extending open channel members 82 which receive guide rollers 84 to guide the bottom edge of the door 13 in its movement between the open and closed positions. The rollers 84 are each supported by axles 86 which are journaled in the bearings 66 described above in connection with the preferred embodiment. These bearings 66 include the bearing extensions 66*a* which serve to interconnect the cable portions 54*a* and 54*b* to the door 13.

The embodiments of the invention described above enable the high lifting forces required to raise the garage door to be applied through the axis of the lower door guides at the bottom edge of the door without interfering with the action of the guides and so that the lifting forces continue to act through the horizontal axis of the guides as the door rotates from the vertical to horizontal position. It is extremely important that utilizing the present invention the high cable loads required particularly in the case of a masonry covered door are applied directly to the garage door and not to the shafts for the lower door guides. This approach of connecting the cables to the bearing extensions allows the load to be applied through the horizontal axis about which the door rotates without any problems involved in high loads to the guide shafts. The journal bearings may be readily modified to accommodate variations in the loading resulting from different facing materials on the door 13 whether wood siding or brick. At the same time the lifting force is applied vertically with no moments or turning forces which would increase the friction on the door guides and increase the lifting force required to open the door.

The use of the multiple cable sections of different diameter described in connection with FIGS. 12 and 13 is important in providing a means of accommodating the smallest diameter possible to the floor mounted pulley which, in turn, permits the lower door guides to be as close to the floor as possible and still be disposed at the lower edge of the door. The use of the small diameter cable allows the use of the small pulley. By using the same diameter cable at the ends of the cable which wind up on the pulley, the cable length remains constant, and there is no need to provide separate tensioning or slack take-up means.

The use of the adjustable door arrestors or stops associated with the floor pulleys provides a simple and effective means eliminating overclosing or misalignment of the door in the closed position. In addition, the arrestors prevent any crushing of the sensing edge.

What is claimed as new and desired to be secured by Letters Patent of the United States is:

1. In a power operated garage door of a type having a one piece door supported for movement between a vertical closed position and a horizontal open position by a pair of vertical guide tracks and a pair of horizontal guide tracks with a pair of guides on the door engaging the vertical guide tracks and a pair of guides engaging the horizontal guide tracks and including power driven flexible cables connected to the door for drawing the door upwardly and downwardly between said open and closed positions, the combination comprising:

a one piece rectangular door having top and bottom edges and side edges and having a pair of guide and drive assemblies mounted on the bottom edge of the door which is a lower-most portion when the door is positioned in a vertical closed position in a garage opening, said door having an inside surface and an outside surface disposed vertically when said door is in the closed position, each said drive and guide assembly including: (a) a guide appendage projecting laterally of said side edges for engagement with vertically extending guide tracks, (b) a cylindrical journal bearing which supports said guide appendage for rotation about a horizontal axis and (c) a mounting plate which is mounted on the bottom edge of said door and which supports said journal bearing below the bottom edge of said door and offset forwardly from said inside surface toward the outside surface on the bottom edge of said door, a jack shaft extending horizontally above said door in the closed position and having a reversible drive means, a pair of cable pulleys fixedly mounted beneath the bottom edge of said door in the vertical position adjacent said side edges, a pair of drive cables each being connected to one of said drive and guide assemblies and driven by said jack shaft, each drive cable having a first portion extending vertically downwardly from said jack shaft to connection with said drive and guide assemblies and a second portion extending vertically downwardly from said jack shaft around one of said cable pulleys and then upwardly to a connection with one of said drive and guide assemblies, said drive cables being disposed between said door side edges and said vertically extending guide tracks when said door is in the vertical closed position.

2. The combination of claim 1 wherein each of said cylindrical journal bearings including portions which extend laterally of said door side edges, said drive cables being connected directly to said laterally extending portions of said cylindrical journal bearings independently of said guide appendages.

3. The combination of claim 1 wherein said jack shaft supports a pair of pulleys to which said cables are connected, each said second cable portion including an upper end which winds on and off of one of said jack shaft supported pulleys and a lower end which extends around one of said cable pulleys and connects to one of said journal bearings, each said first cable portion extending along one of said side edges when said door is in the vertical position and winding onto one of said jack shaft supported pulleys when said door is opened, said first cable portion being equal in diameter to said upper end of said second cable portion and substantially greater in diameter than said lower end of said second cable portion.

4. In a power operated garage door of a type having a one piece door supported for movement between a vertical closed position and a horizontal open position by a pair of vertical guide tracks and a pair of horizontal guide tracks with a pair of guides on the door engaging the vertical guide tracks and a pair of guides engaging the horizontal guide tracks and including power driven flexible cables connected to the door for drawing the door upwardly and downwardly between said open and closed positions, the combination comprising:

a one piece rectangular door having top and bottom edges and side edges and having a pair of guide and drive assemblies mounted on the bottom edge of the door which is a lower-most portion when the door is positioned in a vertical closed position in a garage opening, each said drive and guide assembly including: (a) a guide appendage projecting laterally of said side edges for engagement with vertically extending guide tracks, (b) a cylindrical journal beading which supports said guide appendage for rotation about a horizontal axis and (c) a mounting plate which is mounted on said door and which supports said journal bearing below the bottom edge of said door, a jack shaft extending horizontally above said door in the closed position and having a reversible drive means, a pair of cable pulleys fixedly mounted beneath the bottom edge of said door in the vertical position adjacent said side edges, a pair of drive cables each being connected to one of said drive and guide assemblies and driven by said jack shaft, each drive cable having a first portion extending vertically downwardly from said jack shaft to connection with said drive and guide assemblies and a second portion extending vertically downwardly from said jack shaft around one of said cable pulleys and then upwardly to a connection with one of said drive and guide assemblies, said drive cables being disposed between said door side edges and said vertically extending guide tracks when said door is in the vertical closed position said jack shaft supporting a pair of pulleys to which said cables are connected, each said second cable portion including an upper end which winds on and off of one of said jack shaft supported pulleys and a lower end which extends around one of said cable pulleys and connects to one of said journal bearings, each said first cable portion extending along one of said side edges when said door is in the vertical position and winding onto one of said jack shaft supported pulleys when said door is opened, said first cable portion being equal in diameter to said upper end of said second cable portion and substantially greater in diameter than said lower end of said second cable portion, said jack shaft supported pulleys being of constant diameter and the length of the drive cables extending from said jack shaft supported pulleys remaining constant during the opening and the closing of said door.

5. In a power operated garage door of a type having a one piece door supported for movement between a vertical closed position and a horizontal open position by a pair of vertical guide tracks and a pair of horizontal guide tracks with a pair of guides on the door engaging the vertical guide tracks and a pair of guides engaging the horizontal guide tracks and including power driven flexible cables connected to the door for drawing the door upwardly and downwardly between said open and closed positions, the combination comprising:

a one piece rectangular door having top and bottom edges and side edges and having a pair of guide and drive assemblies mounted on the bottom edge of the door which is a lower-most portion when the door is positioned in a vertical closed position in a garage opening, each said drive and guide assembly including: (a) a guide appendage projecting laterally of said side edges for engagement with vertically extending guide tracks, (b) a cylindrical journal bearing which supports said guide appendage for rotation about a horizontal axis and (c) a mounting plate which is mounted on said door and which supports said journal bearing below the bottom edge of said door, a jack shaft extending horizontally above said door in the closed position and having a reversible drive means, a pair of cable pulleys fixedly mounted beneath the bottom edge of said door in the vertical position adjacent said side edges, a pair of drive cables each being connected to one of said drive and guide assemblies and driven by said jack shaft, each drive cable having a first portion extending vertically downwardly from said jack shaft to connection with said drive and guide assemblies and a second portion extending vertically downwardly from said jack shaft around one of said cable pulleys and then upwardly to a connection with one of said drive and guide assemblies, said drive cables being disposed between said door side edges and said vertically extending guide tracks when said door is in the vertical closed position, a pair of adjustable door stops secured to said cable pulleys and disposed adjacent to said side edges when said door is in the vertical position, said adjustable stops engaging said journal bearings to limit the downward travel of said door and being adjustable to vary the distance from the floor at which the lower edge of the door will be positioned in the closed position.

6. The combination of claim 5 including a sensing edge supported on said bottom edge of said door to sense any obstacles in the path of said door, said sensing edge having a resilient deformable housing positioned between said door stops when said door is in the closed position.

7. The combination of claim 2 wherein each of said first and second cable portions are connected together and to a ring which surrounds and is journaled on a portion of one of said journal bearing extending beyond one of said door edges to permit said cables to apply their forces to said door independently of said guide appendages and through said horizontal axis of said journal bearings as the door rotates in moving between the open and closed positions.

8. A power operated garage door comprising;

a door movable between a vertically disposed position closing an opening in a garage and a horizontally disposed position above said opening and within said garage, a powered door drive including a pair of cables which are driven by a reversible motor to pull said door upwardly to said open position and pull said door downwardly to said closed position, vertically extending tracks disposed adjacent to said door opening, door guide means disposed on said door at horizontally spaced positions on vertically extending edges of said door to guide said door in moving between said open and closed positions, said door guide means each including a guide shaft journaled for rotation at an inner end in a horizontally extending bearing which is secured to said door with a portion projecting beyond one of said edges of said door, each of said guide shafts having an outer end which extends beyond said bearing and supports a guide which engages one of said tracks to guide said door in moving between said closed and open positions, means connecting each of said cables directly to one of said projecting portions of said bearings independently of said guide shafts received in said bearings.

9. The combination of claim 8 wherein said means connecting each of said cables to one of said bearings directs the force of each cable in pulling said door upwardly or downwardly in a direction through a horizontal axis on which both of said guide shafts are disposed.

10. The combination of claim 9 wherein said means connecting each of said cables to one of said bearings comprises a bushing encircling the projecting portion of each bearing, said bushing being connected to each cable intermediate to its ends and on a portion of each cable which extends vertically adjacent said tracks.

11. The combination of claim 10 wherein said bushing comprises a cable thimble, said portion of each cable which extends vertically adjacent said tracks being formed with loop portions secured by a connector and extending around said thimble to secure said thimble to said vertically extending portion of cable.

12. The combination of claim 8 wherein said powered door drive includes a jack shaft supporting pulleys around which said cables are wound and by means of which said cables are driven, said reversible motor driving said jack shaft in either of two directions to selectively open or close said door, a floor mounted pulley disposed in vertical alignment with each of said guide means, each said cable extending downwardly from one of said pulleys on said jack shaft into connection with said guide means and downwardly from said connection with said guide means around said floor pulley and upwardly to said one pulley on said jack shaft.

13. A power operated garage door comprising;

a door movable between a vertically disposed position closing an opening in a garage and a horizontally disposed position above said opening and within said garage, a powered door drive including a pair of cables which are driven by a reversible motor to pull said door upwardly to said open position and pull said door downwardly to said closed position, vertically extending tracks disposed adjacent to said door opening, door guide means disposed on said door at horizontally spaced positions on vertically extending edges of said door to guide said door in moving between said open and closed positions, said door guide means each including a guide shaft journaled for rotation at an inner end in a horizontally extending bearing which is secured to said door with a portion projecting beyond one of said edges of said door, each of said guide shafts having an outer end which extends beyond said bearing and supports a guide which engages one of said tracks to guide said door in moving between said closed and open positions, means connecting each of said cables to one of said projecting portions of said bearings, said powered door drive including a jack shaft supporting pulleys around which said cables are wound and by means of which said cables are driven, said reversible motor driving said jack shaft in either of two directions to selectively open or close said door, a floor mounted pulley disposed in vertical alignment with each of said guide means, each said cable extending downwardly from one of said pulleys on said jack shaft into connection with said guide means and downwardly from said connection with said guide means around said floor pulley and upwardly to said one pulley on said jack shaft, a pair of adjustable door stops secured to said floor mounted pulleys and disposed adjacent to said door edges when said door is in the closed position, said adjustable stops engaging said bearings to limit the downward travel of said door and being adjustable to vary the distance from the floor at which the lower edge of the door will be positioned in the closed position.

14. The combination of claim 13 wherein said means connecting each of said cables to one of said bearings comprises a bushing secured to one of said cables at an intermediate portion extending vertically between said jack shaft and said floor pulley to direct the force applied by said cable to said guide means through a horizontal axis about which said guide shafts rotate.

15. The combination of claim 12 wherein said cable portions extending downwardly from said pulleys on said jack shaft to said connection with said guide means and to said floor pulleys are disposed in the same vertical plane as said vertically extending tracks.

16. The combination of claim 8 wherein each said track comprises a tube having a generally cylindrical guiding surface and each said guide having a complimentary shape to receive and partially enclose said tube and slidably engage said surface to guide said guide means for vertical movement.

17. The combination of claim 8 wherein said vertically extending tracks each comprise an open channel member extending vertically with the channel being open in the portion facing the door, each said door guide being a roller received in one of said channel members and engaging said channel member to restrict said guide means for vertical movement with respect to said track.

18. In a power operated garage door of a type having a one piece door supported for movement between a vertical closed position and a horizontal open position by a pair of vertical guide tracks and a pair of horizontal guide tracks with a pair of guides on the door engaging the vertical guide tracks and a pair of guides engaging the horizontal guide tracks and including power driven flexible drive means connected to the door for drawing the door upwardly and downwardly between said open and closed positions, the combination comprising:

a one piece rectangular door having top and bottom edges and side edges and having a pair of guide and drive assemblies mounted on the bottom edge of the door which is a lower-most portion when the door is positioned in a vertical closed position in a garage opening, one of said drive and guide assemblies including: (a) a guide appendage projecting laterally of said side edges for engagement with vertically extending guide tracks, (b) a cylindrical journal bearing which extends laterally of said side edge and which supports said guide appendage for rotation about a horizontal axis, (c) a mounting plate which is mounted on said door and which supports said journal bearing at the bottom edge of said door, a jack shaft extending horizontally above said door in the closed position and having a reversible drive means, a floor pulley fixedly mounted beneath the bottom edge of said door in vertical alignment with one of said side edges when the door is in the closed vertical position, a flexible drive means connected to one of said drive and guide assemblies and driven by said jack shaft, said flexible drive means having a first portion extending vertically downwardly from said jack shaft to connection directly with said journal bearing independently of said guide appendage and a second portion extending vertically downwardly from said jack shaft around said floor pulley and then upwardly to a connection with said journal bearing.

19. The combination of claim 18 wherein said first and second flexible drive means portions are connected together and to a ring which surrounds and is journaled on a portion of said journal bearing extending beyond one of said door edges to permit said flexible drive means to apply their forces to said door independently of said guide appendages and through said horizontal axis of said journal bearings as the door rotates in moving between the open and closed positions.

20. The combination of claim 19 wherein said flexible drive means comprises a stranded cable and said ring which is journaled on said portion of said journal bearing extending beyond one of said door edges is a cable thimble around which the ends of said cable extends and are secured together by a cable connector.

21. In a power operated garage door of a type having a one piece door supported for movement between a vertical closed position and a horizontal open position by a pair of vertical guide tracks and a pair of horizontal guide tracks with a pair of guides on the door engaging the vertical guide tracks and a pair of guides engaging the horizontal guide tracks and including power driven flexible drive means connected to the door for drawing the door upwardly and downwardly between said open and closed positions, the combination comprising:

a one piece rectangular door having top and bottom edges and side edges and having a pair of guide and drive assemblies mounted on the bottom edge of the door which is a lower-most portion when the door is positioned in a vertical closed position in a garage opening, one of said drive and guide assemblies including: (a) a guide appendage projecting laterally of said side edges for engagement with vertically extending guide tracks, (b) a cylindrical journal bearing which extends laterally of said side edge and which supports said guide appendage for rotation about a horizontal axis, (c) a mounting plate which is mounted on said door and which supports said journal bearing at the bottom edge of said door, a jack shaft extending horizontally above said door in the closed position and having a reversible drive means, a floor pulley fixedly mounted beneath the bottom edge of said door in vertical alignment with one of said side edges when the door is in the closed vertical position, a flexible drive means connected to one of said drive and guide assemblies and driven by said jack shaft, said flexible drive means having a first portion extending vertically downwardly from said jack shaft to connection with said journal bearing and a second portion extending vertically downwardly from said jack shaft around said floor pulley and then upwardly to a connection with said journal bearing, said first and second flexible drive means portions being connected together and to a ring which surrounds and is journaled on a portion of said journal bearing extending beyond one of said door edges to permit said flexible drive means to apply their forces to said door independently of said guide appendages and through said horizontal axis of said journal bearings as the door rotates in moving between the open and closed positions, said flexible drive means comprising a stranded cable and said ring which is journaled on said portion of said journal bearing extending beyond one of said door edges comprising a cable thimble around which the ends of said cable extends and are secured together by a cable connector, said first portion of said flexible drive means extending around said thimble and being joined together by said connector forming a loop around said thimble, said second portion of said flexible drive means having an end portion extending upwardly and having its strands divided to pass on either side of said thimble and into engagement with said connector above said thimble.

22. The combination of claim 21 including a jack shaft supported pulley to which said cable is connected, said second cable portion including an upper end which winds on and off of said jack shaft supported pulley and a lower end which extends around said floor pulley and connects to said journal bearing, said first cable portion extending along one of said side edges when said door is in the vertical position and winding onto said jack shaft supported pulley when said door is opened, said first cable portion being equal in diameter to said upper end of said second cable portion and substantially greater in diameter than said lower end of said second cable portion.

* * * * *